United States Patent [19]

Cooke

[11] 4,054,272

[45] Oct. 18, 1977

[54] PAINT AND BEDDING BLENDER

[76] Inventor: Bernard G. Cooke, Rte. 1, Box 122AA, Boyd, Tex. 76023

[21] Appl. No.: 680,103

[22] Filed: Apr. 26, 1976

[51] Int. Cl.[2] ..... B01F 7/16

[52] U.S. Cl. ..... 366/343; 366/330; 366/605

[58] Field of Search ..... 259/107, 108, 122

[56] References Cited

U.S. PATENT DOCUMENTS

| | | | |
|---|---|---|---|
| 7,046 | 1/1850 | Young | 259/108 |
| 1,841,435 | 1/1932 | Gibson | 259/107 |
| 2,799,485 | 7/1957 | Silverman | 259/107 |
| 2,896,925 | 7/1959 | Ploce | 259/107 X |
| 3,307,834 | 3/1967 | Wilde | 259/122 X |

*Primary Examiner*—Edward J. McCarthy
*Attorney, Agent, or Firm*—James C. Fails

[57] ABSTRACT

A blender for mixing slurries, suspensions and the like that include particulate solids in a liquid characterized by a plurality of blades disposed along a bottom mixing zone of an elongate central shaft, the blades being fixedly connected with the shaft and extending radially outwardly therefrom and balanced to minimize rotational vibration; the blades all having a twist therealong. A bottom blade is twisted so that the outer radial portions have a critical angle $\alpha$ with the trailing edge tilted upwardly for moving the solids radially outwardly and upwardly. A second blade at the top of the mixing zone is bent downwardly and also has a twist, the angles of bend and twist being such that the solids are forced radially inwardly and downwardly to a plurality of mixing blades therebelow and splash is prevented. An intermediate mixing blade is provided with critical angles on the outer radial portions for mixing and forcing the solids downwardly. This blender enables thorough mixing and achieving a substantially uniform admixture of the solids in the liquid in only a few minutes whereas up to hours have been necessary by the prior art blenders or shakers.

4 Claims, 12 Drawing Figures

PAINT AND BEDDING BLENDER

BACKGROUND OF THE INVENTION

1. Field of the Invention:

This invention relates to blenders for admixing solids and liquids to form slurries, suspensions and the like. In a particular aspect, this invention relates to a portable paint and bedding blender that achieves surprisingly improved results, even when blending on the job and as compared with the prior art apparatus for mixing at a central location.

2. Description of the Prior Art:

There has been a continuing need for blenders for admixing a plurality of widely varying mixtures, such as slurries, suspensions and the like. Typical of the widely varying types of ingredients that require mixing of the solids in a liquid are taping mud, bedding materials, Textone, Bondex, block filler, tile grout, inside paints, ready-mix muds, lead and oil paints, outside paints, water paints, and color stains. As will be appreciated, the viscosity of the ingredients vary widely from the very low viscosity color stains to the very high viscosity taping mud and tile grout. The prior art showed a variety of single and multiple blade mixers and shakers. The mixers that have been available for on the job use have tended to mix only the central portion of the materials, leaving a large portion of the solids unmixed, and have tended to throw the materials out of the mixing containers. The shakers were disadvantageous in that the material had to be taken to the central location where the shaker was located and the solids tended to settle out before they could be again brought to the job. Moreover, the shakers were not totally satisfactory for the more viscous materials, frequently leaving a large portion of the solids unmixed.

Accordingly, it can be seen that the prior art has failed to provide a totally satisfactory blender for mixing solids in a liquid. In particular, the prior art has failed to provide a mixer that can be employed on the job for mixing in available containers, ranging from 1 and 5 gallon buckets through 10 gallon, fifteen gallon containers to twenty gallon barrels or the like, without throwing the material from the container in which it is being mixed.

SUMMARY OF THE INVENTION

Accordingly, it is an object of this invention to provide a mixer that can be employed to mix solids in a liquid while obviating the disadvantages of the prior art approaches.

It is a particular object of this invention to provide a portable mixer that can be employed in a wide variety of containers, yet achieves superior mixing on the job in a much shorter time than the prior art while alleviating the disadvantages of the prior art.

These and other objects will become apparent from the descriptive matter hereinafter, particularly when taken in conjunction with the appended drawings.

In accordance with this invention, there is provided a blender for mixing slurries, suspensions and the like that include particulate solids in a liquid. The blender comprises an elongate central shaft and a plurality of three critically angled blades fixedly connected with the shaft at predetermined locations in a mixing zone along the bottom portion of the shaft. The shaft has first and second ends that serve operationally as top and bottom ends. The shaft is adapted at its top end for being connected with a power driven rotary means for rotation in a predetermined direction. The blades extend radially outwardly from the shaft and are balanced on each side of the shaft for minimal rotational vibration. At least three blades are employed. First, a bottom blade is disposed adjacent the bottom end of the shaft and has a twist such that it defines a plurality of angles with respect to a plane that is radially perpendicular at all points to the central longitudinal axis of the shaft. The first, or bottom, blade includes a central portion that is substantially parallel with the plane for moving the solids radially outwardly and respective outer radial portions that form an angle $\alpha$ with respect to the plane, with the trailing edge tilted upwardly, for moving the solids radially outwardly and upwardly. A second, or top, blade is disposed at a second predetermined location intermediate the ends of the shaft and adjacent the top of the mixing zone of the shaft. The second blade also has a twist with the outer radial portions having an angle $\gamma$ with respect to the plane and bent downwardly at an angle $\beta$ with respect to the plane. The angle $\gamma$ can also be thought of, or measured, with respect to a second plane passing through the blade at the point of measurement of the angle and disposed at the angle $\beta$ with respect to the plane that is perpendicular to the central longitudinal axis of the shaft. The combination of the downwardly bent and downwardly angled, or twisted, outer radial portions of the second blade prevents splashing and circulates the solids inwardly and downwardly to a plurality of blades therebelow. There is at least one intermediate blade disposed at a predetermined third location intermediate the first and second blades. The intermediate blade also has a twist such that it defines a plurality of angles with respect to the plane. The intermediate blade has a central portion that is substantially parallel with the plane and respective outer radial portions that have an angle $\phi$ with respect to the plane, with the trailing edge tilted downwardly, for mixing the solids and moving the solids downwardly toward the first blade. At the first blade, the solids are again mixed and circulated. The overall effect is that rapid mixing takes place and a substantially uniform mixture of all of the solids in the liquid is formed much more rapidly than in the prior art apparatus.

DESCRIPTION OF PREFERRED EMBODIMENT(S)

One of the advantages of this invention is that it is widely useful and can be employed for effecting a substantially uniform admixture of all of the materials delineated hereinbefore. For simplicity in illustrating its operation, however, it will be described hereinafter with respect to admixing paint pigment into the liquid solution in which it is applied.

Figure 1:
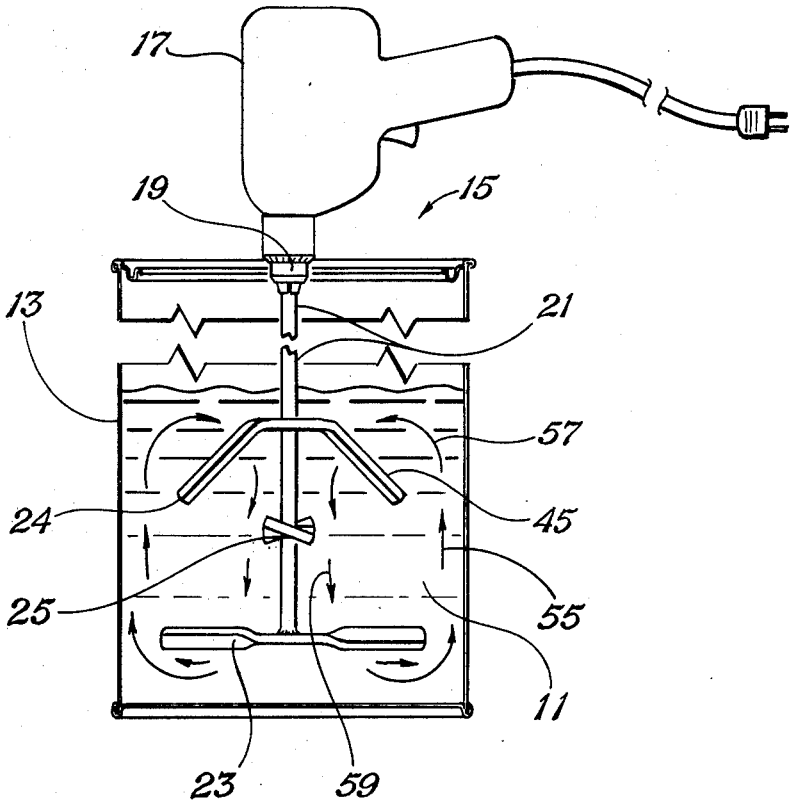
FIG. 1 is a side elevational view, partly in section, showing one embodiment of this invention.

Referring to FIG. 1, the paint 11 is being admixed in a container 13 by the blender 15. A rotary power means, such as a variable speed electric drill 17, serves as the source of rotational power to impart rotation to the blender 15. While a drill 17 is being specifically described herewith, any rotary powered means, stationary or portable, may be employed to impart rotation to the blender 15. The conventional ½ inch drill is readily connected by way of chuck 19. For example, the chuck 19 comprises any of the chucks, for holding ½ inch drill bits or the like, with a gear thread top that can be screwed to tighten holding jaws within the chuck against a shaft, or bit.

Figure 2:
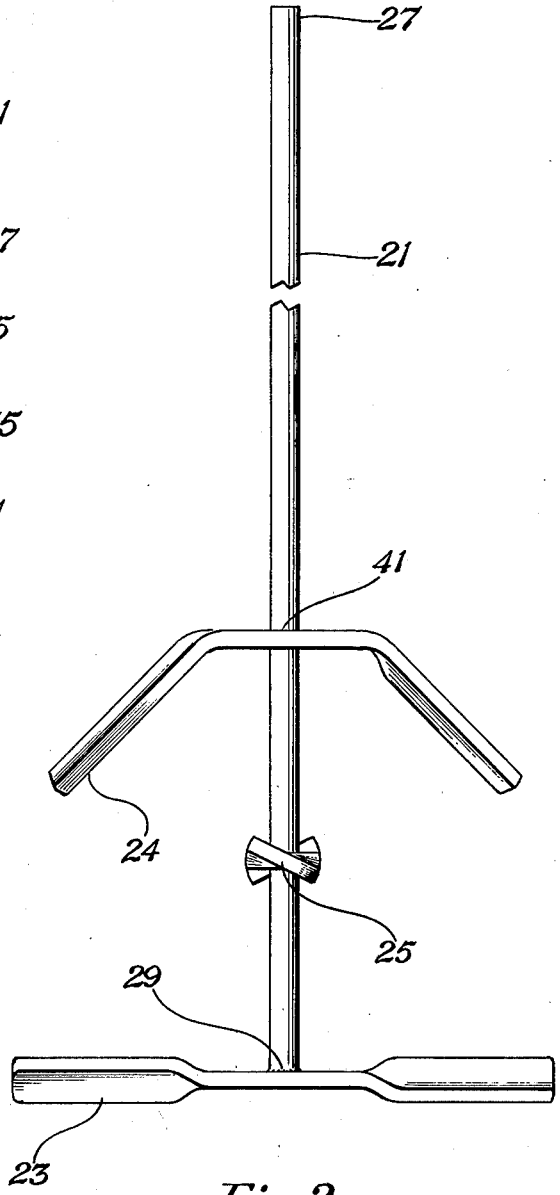
FIG. 2 is a side elevational view of the shaft and blades of the embodiment of FIG. 1.
Figure 3:
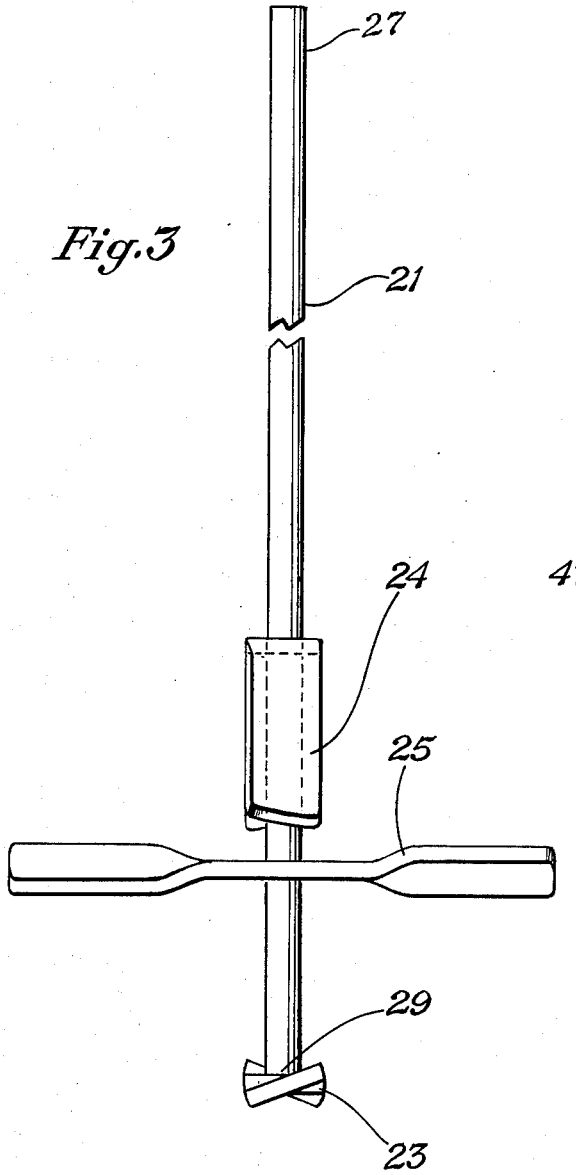
FIG. 3 is an end elevational view of the shaft and blades of FIG. 2.

The blender 15 comprises an elongate central shaft 21 and a plurality of circulating and mixing blades 23–25, FIGS. 1–3.

The central shaft 21 is an elongate shaft having a central longitudinal axis and being substantially straight for minimizing vibration when rotating. The shaft 21 may take any of the conventional shapes and may be solid or tubular in construction. As illustrated, the shaft 21 is a solid, substantially cylindrical shaft to simplify construction. The shaft 21 has first and second ends 27 and 29 that serve, in operation, respectively, as top and bottom ends. The first, or top, end, 27, FIGS. 2, 3, is adapted for being connected with the power rotary means for rotation in a predetermined direction. As illustrated, the top end 27 is substantially smoothly cylindrical for insertion within the chuck 19 of the drill 17. If desired, the top end 27 may comprise any of the other shapes, such as square, hexagonal, octagonal, or splined for being inserted into mating apertures within the rotary means to impart rotation to the blender 15. The shaft 21 may be formed of any material that will withstand the torsional forces necessary for the mixing job. As illustrated, the shaft 21 is formed of steel. Where corrosive materials are to be admixed, the shaft 21 is formed of corrosion resistant material, such as stainless steel, plastic, brass, or the like. In other applications, other metals, such as aluminum, or plastic, can be employed as long as it will transmit the rotational torque to the blades 23–25.

The respective blades are fixedly connected with the shaft 21 at predetermined locations along the shaft. The blades extend radially outwardly from the shaft at their respective angles. The blades are balanced on each side of the shaft for minimal rotational vibration.

The blades are affixed to the shaft 21 such that each lower adjacent blade is offset at a predetermined angle with respect to the adjacent higher blade. As illustrated, each blade is offset 90° such that the adjacent blades are perpendicular for smoother, more efficient mixing.

Figure 6:
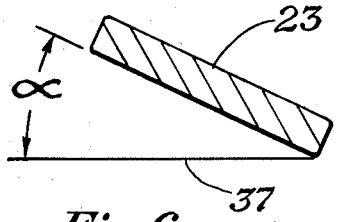
FIG. 6 is a partial cross sectional view taken along the lines VI—VI of FIG. 5.
Figure 4:
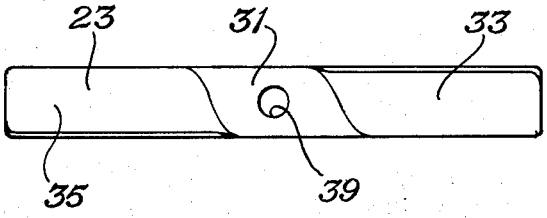
FIG. 4 is a top plan view of the first, or bottom, blade of FIG. 1.
Figure 5:
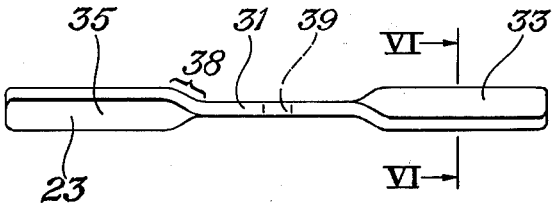
FIG. 5 is a side elevational view of the first blade of FIG. 4.

There are at least three blades. The first blade 23 is disposed at a first location adjacent the bottom end of the shaft 21. The first blade 23, FIGS. 4–6, has a twist such that it defines a plurality of angles with respect to a plane that is radially perpendicular to the central longitudinal axis of the shaft at all points. The first blade includes a central portion 31 and respective outer radial portions 33 and 35. The central portion 31 may have any angle that will effect radially outward movement and admixing of the solids, such as the paint pigment; and to a lesser extent, the liquid. As illustrated, the central portion 31 is substantially parallel with the radially perpendicular plane described hereinbefore. The respective outer radial portions make an angle $\alpha$, FIG. 6, with respect to the radially perpendicular plane 37, with the trailing edge tilted upwardly for moving the solids radially outwardly and upwardly so that the solids are circulated for being more thoroughly mixed more rapidly than in the prior art. As illustrated, the blade 23 is substantially continuous with a twist that forms a continuum over the transitional region 38. If desired, the upwardly angled (to indicate the direction of the trailing edge and in which the solids are moved) portion of the blade may be otherwise affixed, as by welding or the like. The smooth transition is preferred, however, since it enables smooth mixing with lower power consumption.

The angle $\alpha$ is varied depending upon the length and rotational speed of the blade 23 and the viscosity of the material, or slurry, being admixed. For the portable units that are employed for on-the-job mixing, it has been found that the angle $\alpha$ must be between 15° and 35° to obtain best mixing. For example, with an ½ inch drill, I have found that about the optimum angle $\alpha$ is about 25°.

The blade 23 may be attached to the shaft 21 by any conventional means. For example, it may be affixed by a collar and suitable set screws; affixed by mating splines, key and slot combinations; or affixed by welding. As illustrated, the blade 23 has an aperture 39 that closely fits the outer perimeter of the cylindrical shaft 21 and is welded into place. If desired, it could be shrink fitted thereonto, with or without the above described kee way and slot combination.

The blade 23 may be formed of any of the materials that are structurally adequate for admixing and circulating the solids in the slurry being admixed. As illustrated, the blade is formed of steel or wrought iron. Similarly, as with the shaft 21, if corrosive materials are being admixed, the blade 23 will be formed of corrosion resistant material, such as stainless steel, plastic, or brass. On the other hand, for noncorrosive materials, other metals such as aluminum or plastic may be employed.

Where the term "plastic" is employed herein, it may comprise either the thermosetting materials such as the phenol formaldehyde copolymers; the thermoplastic materials such as polyvinyl chloride, polypropylene, densified polyethylene, polyurethane; epoxy or other catalytically set resins or polymers; or other thermoplastic materials such as the acrylonitrile butadiene styrene copolymer (ABS). Of course, the plastic that is employed must be suited to the admixing job to be done and resist warping under the forces developed during rotation and admixing of the solids in the liquid.

Figure 7:
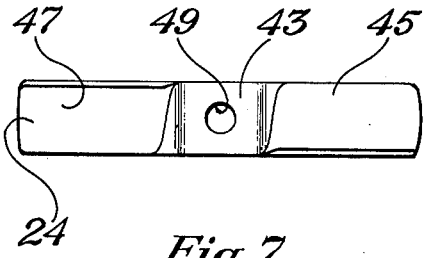
FIG. 7 is a top plan view of the top, or second, blade of FIG. 1.
Figure 8:
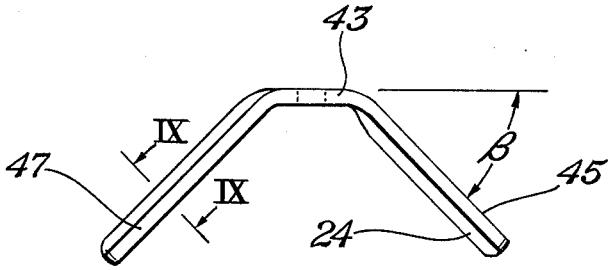
FIG. 8 is a side elevational view of the top blade of FIG. 7.
Figure 9:
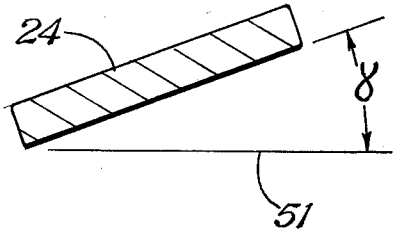
FIG. 9 is a partial cross sectional view taken along the lines IX—IX of FIG. 8.

The second blade 24, FIGS. 7–9, is disposed at the second predetermined location 41, FIG. 2, intermediate the ends of the shaft 21 and adjacent a top of a predetermined mixing zone along the bottom portion of the shaft. The second blade 24 also has a twist such that it defines a plurality of angles with respect to the radially perpendicular plane. The second blade 24 has a central portion 43 and a plurality of outer radial portions 45 and 47. The central portion 43, similarly as with central portion 31 of the first blade 23, is substantially parallel with the radially perpendicular plane. The outer radial portions 45 and 47 are twisted so as to form an angle $\gamma$ with respect to a plane 51. The plane 51 may be thought of as either the substantially radially perpendicular plane the same as or parallel with the plane 37, FIG. 6, if the blade 24 is in its prebent configuration. On the other hand, the angle $\gamma$ may be measured with respect to a plane making the angle $\beta$ with respect to the radially perpendicular plane and passing through the blade at the point where the angle $\gamma$ is measured. In measuring the angle $\gamma$, the trailing edge of the second blade is directed downwardly such that the solids will be deflected downwardly for further mixing by a plurality of blades therebelow. The angle $\gamma$ should be in the range of 10°–30°, the best angle being about 20°. The angle $\gamma$ can be less than $\alpha$, because the downwardly bent portions 45 and 47 tend to circulate the solids downwardly of their own volition. In addition, the outer radial portions 45 and 47 are bent downwardly at an angle $\beta$ with respect to the radially perpendicular plane. As illustrated, the blade 24 is substantially continuous, although the outer radial portions may be welded to the central portion, or otherwise affixed, if desired.

The radially outer portions 45 and 47 are bent downwardly to prevent splashing of the slurry being admixed and to circulate the particulate solids inwardly and downwardly. The angle $\beta$ may be varied from between about 35 and 55° for the embodiments that have been tested to date, although the best embodiment has been found to be about 45° for employing with the portable electric drill.

Similarly as described hereinbefore, the blade 24 can be fixedly connected with the shaft 21 by any of the means described hereinbefore with respect to the first blade 23. As illustrated, the blade 24 has an aperture 49 that conformingly fits with the exterior of the shaft 21 and the blade 24 is welded to the shaft 21.

The second blade 24, similarly as the first blade may be formed of any suitable metallic or plastic materials that are able to impart the torque necessary for mixing and circulating of the solids in the liquid. As illustrated, the first blade 24 is formed of steel or wrought iron. Where corrosive materials are to be admixed, it will be formed of corrosion resistant materials, such as stainless steel, plastic, or brass. Other metals, such as aluminum, or plastic may be employed for forming the blade.

Figure 10:
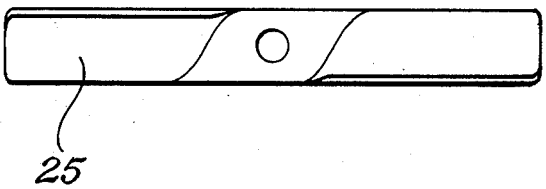
FIG. 10 is a top plan view of the intermediate blade of FIG. 1.
Figure 11:
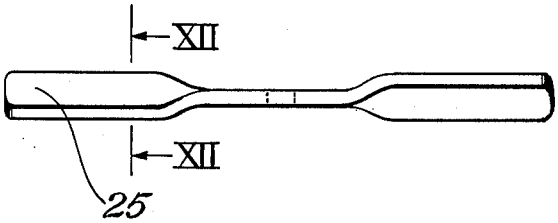
FIG. 11 is a side elevational view of the intermediate blade of FIG. 10.
Figure 12:
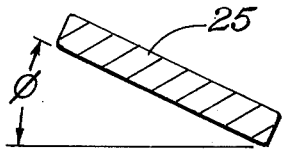
FIG. 12 is a partial cross sectional view taken along the lines XII—XII of FIG. 11.

The intermediate blade 25, FIGS. 10–12, comprises a mixing and circulating blade that is similar in construction to the first blade 23, although the outer radial portions are twisted in an opposite configuration at the angle $\phi$ in order to admix and deflect the solids downwardly into the first blade 23.

The intermediate blade 25 may be formed of similar materials and attached to the shaft 21 similarly as was the first blade 23. As illustrated, the aperture conformingly fits the shaft 21 and the blade 25 is welded thereto. If desired, it may be structurally somewhat less strong, since it will not be called upon to stir and begin the admixing of the more densely packed solid materials that may have fallen to the bottom of a container, as was the bottom blade 23. The angle $\phi$, similarly as the angle $\alpha$, will be in the range of 15°–35° but with the trailing edge downwardly for downward deflection of the solids. The optimum angle for $\phi$ is about 25° for the portable units tested thus far.

In operation, the blender 15 is connected with the prime mover, such as the drill 17. The blades are submerged in the liquid portion of the slurry to be admixed and rotation is started. The bottom blade 23 moves the solids outwardly and upwardly while admixing them with the liquid also being so circulated, though more slowly. As the solids and slurry travel upwardly at the radially outermost portions within the container 13, as indicated by arrows 55, they move to the top and are moved inwardly, as shown by the arrows 57. The slurry is pulled inwardly and further admixed by the top blade 24. The downwardly bent portions 45 and 47 prevent splashing and through the bent angle $\beta$ and the twist angle $\phi$, cause the solids and slurry to be admixed and circulated downwardly. The solids and the liquid portion of the slurry move at different speeds because of the different densities and the different response to the impact of the blades so that a more nearly uniform admixture is rapidly formed.

The intermediate blade 25 further rapidly admixes the liquid and solid components of the slurry and moves the solids rapidly downwardly, as indicated by arrows 59. Because of the different rapidity of movement and of the substantially uniform and turbulent movement of both the solids and the liquids in the container, a substantially uniform admixture is formed within a matter of 5 to 10 minutes for paints, bedding and the like that formerly required up to 3 to 4 hours to admix in the field, or on the job. In the illustrated embodiment, the blades are twisted to form the preferred angles delineated hereinbefore, the top blade being also bent at the preferred angle. As an example, a satisfactory portable unit has been formed with a shaft about twenty-seven inches in length and being of solid substantially cylindrical steel. For being employed in size containers ranging from 5 gallon buckets to twenty gallon barrels, the blades may be about 1¼ inch wide and about 9½ inches long, being about ¼ inch thick. The shaft 21 is about ½ inch in diameter and has been found to impart the necessary torque to satisfactorily rotate the respective blades.

The admixtures that is formed is so nearly uniform that even color is attained through different regions when painted. The machine has been demonstrated to produce better results than a $7,000 shaker, the operators of this invention required only 3 minutes to form the uniform admixture that the shaker required 30 minutes to do, even at a central location.

While the use of mating apertures and/or chucks and shafts have been described hereinbefore as the interconnection between the rotary means and the shaft 27 of the blender 15, any other conventional means may be employed. For example, set screws or the like may be employed to interconnect the two.

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. A portable blender for mixing in a portable container slurries, suspensions and the like that include particulate solids in a liquid comprising:

a. an elongate central shaft having a central longitudinal axis and first and second ends serving in an operational position respectively as top and bottom ends; said shaft being adapted at its top end for being connected into a chuck for a controllable speed electric drill motor of predetermined size for rotation in a predetermined direction; and b. a plurality of blades fixedly connected with said shaft at predetermined locations therealong and extending radially outwardly therefrom; said blades being balanced on each side of said shaft for minimum rotational vibration; said plurality of blades including:

i. a first blade disposed at a first location adjacent the bottom end of said shaft; said first blade having a twist such that it defines a plurality of angles with respect to a plane that is radially perpendicular at all points to said central longitudinal axis of said shaft; said first blade including a central portion that is substantially parallel with said plane for moving said solids radially outwardly and respective outer radial portions that have a critical first angle $\alpha$ with a trailing edge tilted upwardly for moving said solids radially outwardly and upwardly such that said solids are circulated radially outwardly and upwardly to be thoroughly mixed; said critical first angle $\alpha$ being within the range of 15°–35°;

ii. a second blade disposed at a second predetermined location intermediate the ends of said shaft and adjacent a top of a predetermined mixing zone along the bottom portion of said shaft; said second blade also having a twist such that it defines a plurality of angles with respect to said plane; said second blade having a central portion that is substantially parallel with said plane and outer radial portions that are bent downwardly at a critical second angle $\beta$ and also define a critical third angle $\gamma$ with the trailing edge tilted downwardly with respect to a second plane at said angle $\beta$ and passing through said blades where the angle $\gamma$ is measured such that splashing outside said container is prevented and said solids are circulated inwardly and downwardly to a plurality of blades therebelow for more thorough mixing; said critical second angle $\beta$ being within the range of 35°–55° and said critical third angle $\gamma$ being within the range of 10°–30°;

iii. at least one intermediate blade disposed at a predetermined third location intermediate said first and second blades; said intermediate blade having a twist such that it defines a plurality of angles with respect to said plane; said intermediate blade including a central portion that is substantially parallel with said plane and respective outer radial portions that have a critical fourth angle $\phi$ with the trailing edge tilted downwardly for mixing said solids and moving said solids downwardly to said first blade for repeated mixing and circulation; said critical fourth angle $\phi$ being within the range of 15°–35°;

said blades having a width that is no greater than 1¼ inches and substantially uniform therealong; said blades being affixed to the shaft in operation such that each lower adjacent blade is offset at a predetermined angle with respect to the adjacent higher blade such that thorough mixing and a substantially uniform admixture of said solids in said liquid is formed rapidly with nominal torque requirements and without requiring torque so high as to damage said electric drill motor.

2. The blender of claim 1 wherein said angles are about as follows: $\alpha$-25°, $\beta$-45°, $\gamma$-20° and $\phi$-25°.

3. The blender of claim 1 wherein said predetermined angle is 90° such that each lower blade is substantially perpendicular to the adjacent higher blade.

4. The blender of claim 3 wherein there are three blades, said first and second blades being coplanar and said intermediate blade lying in a plane substantially 90° thereto.

* * * * *